US006293244B1

(12) United States Patent
Mullins et al.

(10) Patent No.: US 6,293,244 B1
(45) Date of Patent: Sep. 25, 2001

(54) OIL FLOW CONTROL SYSTEM FOR ENGINE CYLINDER HEAD

(75) Inventors: Jeffrey Allen Mullins, Allen Park; Matthew Byrne Diggs, Farmington; Michael Joseph Schrader, Belleville, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/566,709

(22) Filed: May 9, 2000

(51) Int. Cl.[7] ..... F01M 11/02

(52) U.S. Cl. ..... 123/196 R; 123/196 M

(58) Field of Search ..... 123/196 R, 196 M, 123/196 CP, 196 S, 195 C, 193.5, 90.31, 90.33

(56) References Cited

U.S. PATENT DOCUMENTS

| | | | | |
|---|---|---|---|---|
| 4,537,164 | * | 8/1985 | Ajiki et al. | 123/90.16 |
| 4,672,926 | * | 6/1987 | Gadefelt et al. | 123/90.34 |
| 4,694,787 | * | 9/1987 | Rhoads | 123/90.13 |
| 4,754,729 | * | 7/1988 | Abe et al. | 123/90.38 |
| 4,823,747 | | 4/1989 | Wagner et al. . | |
| 4,862,843 | | 9/1989 | Kawamoto et al. . | |
| 4,944,265 | * | 7/1990 | Davey | 123/196 R |
| 5,172,661 | | 12/1992 | Brune et al. . | |
| 5,327,859 | | 7/1994 | Pierik et al. . | |
| 5,363,817 | | 11/1994 | Ikeda et al. . | |
| 5,507,259 | * | 4/1996 | Tanaka | 123/196 M |
| 5,601,057 | * | 2/1997 | Treyz et al. | 123/90.16 |
| 5,657,725 | | 8/1997 | Butterfield et al. . | |
| 5,666,914 | | 9/1997 | Ushida et al. . | |
| 5,704,330 | * | 1/1998 | Tsuchida | 123/193.5 |
| 5,718,196 | * | 2/1998 | Uchiyama et al. | 123/195 C |
| 5,721,375 | | 2/1998 | Bidner . | |
| 5,799,631 | * | 9/1998 | Nakamura | 123/90.17 |
| 5,803,030 | | 9/1998 | Cole . | |
| 5,836,278 | | 11/1998 | Scheidt . | |
| 5,954,019 | * | 9/1999 | Yoshikawa et al. | 123/90.17 |
| 6,076,492 | * | 6/2000 | Takahashi | 123/90.17 |
| 6,182,625 | * | 2/2001 | Ozeki et al. | 123/90.33 |
| 6,186,105 | * | 2/2001 | Yonezawa | 123/90.17 |

FOREIGN PATENT DOCUMENTS 4-140458 5/1992 (JP) .

* cited by examiner

*Primary Examiner*—Noah P. Kamen
*Assistant Examiner*—Hai Huynh
(74) *Attorney, Agent, or Firm*—Jerome R. Drouillard

(57) ABSTRACT

A system for controlling a flow of pressurized oil in an internal combustion engine includes a cylinder head having a generally-flat external surface featuring a pressurized oil outlet and a pressurized oil inlet; and an oil flow control module including a generally-flat mating surface secured against the first surface of the cylinder head such that a first passage in the module places the outlet of the cylinder head in fluid communication with the inlet of the cylinder head. While the module's first passage minimally includes an oil restrictor, preferably, in a downstream portion thereof, the module preferably further includes a screen filter, and a spool valve operative to direct unrestricted oil flowing through the first passage into one of a plurality of fluid lines operatively connected to the cam phaser unit, whereupon the spool valve is used to variably advance or retard engine cam timing.

24 Claims, 3 Drawing Sheets

OIL FLOW CONTROL SYSTEM FOR ENGINE CYLINDER HEAD

BACKGROUND OF THE INVENTION

1. Field of the Invention

The invention relates internal combustion engines which include variable cam timing systems, wherein a flow of valvetrain-lubricating oil to the cylinder head is controllably diverted to thereby provide pressurized fluid to a cam phaser unit, for example, mounted on an end of a cam shaft.

2. Background Art

The prior art teaches internal combustion engines wherein a fixed relationship between camshaft rotation and crankshaft rotation is maintained to thereby preserve the relationship between intake and exhaust vale events and piston motion. Alternatively, the prior art teaches so-called variable cam timing engines which seek to adjust this relationship to thereby achieve various advantages including increased fuel economy and reduced regulated emissions. Under one prior art approach, as disclosed in U.S. Pat. No. 5,363,817, actual cam timing is measured using a toothed wheel on the camshaft and a toothed wheel on the crankshaft. The time, or angle, between receiving pulses from the wheel on the crankshaft and the wheel on the camshaft represents the actual cam timing. A desired cam timing is determined as a function of engine operating conditions, and an error signal is created from the difference of the desired cam timing and the actual cam timing. Control signals based upon the error signal are then generated and supplied to actuators capable of adjusting the cam timing, typically by supplying pressurized oil to a solenoid valve for controllably directing pressurized oil to a selected passage in the camshaft which, in turn, directs the pressurized oil to an oil-pressure-responsive cam phaser unit.

Significantly, in such a system, the cylinder heads are specifically designed for variable cam timing, i.e., the heads include oil-porting passages to communicate pressurized oil to the passages defined in the camshaft. Such systems thus require extensive design considerations and machining of the heads and camshaft to accommodate the oil passages, as well as consideration to the mounting of the solenoid valves.

Alternatively, the prior art teaches use of ported camshaft bearings to define the paths by which pressurized oil is supplied to the cam phaser unit. Such ported camshaft bearings either require similar oil-porting passages in the cylinder head, or external oil routing tubes and flow control structures which, in turn, present additional packaging and mechanical attachment issues, each serving to increase the cost of providing variable cam timing to an existing engine that has fixed cam timing.

SUMMARY OF THE INVENTION

It is an object of the invention to provide simplified oil supply and control system for a variable cam timing system of an internal combustion engine and, particularly, a system and method for controlling such oil flow by which given engine architectures are selectively provided with either fixed cam timing or variable cam timing.

Under the invention, a system for controlling oil flow to the cylinder head of an internal combustion engine includes an oil flow control module having a generally-flat mating surface that is secured against a generally-flat external surface of the cylinder head. The oil flow control module includes at least a first passage that places a pressurized oil outlet defined in the external surface of the cylinder head in fluid communication with an oil inlet, also defined in the external surface of the cylinder head.

In accordance with a feature of the invention, the first passage of the module includes an oil restrictor, such as a first section having a relatively-reduced hydraulic diameter. Preferably, the first passage further defines a reservoir disposed between the restrictor and the inlet of the cylinder head and, preferably, arranged to be positioned on the engine below the inlet of the cylinder head, whereby oil is contained in the reservoir during engine shut-off. In this manner, the module advantageously insurers a supply of valvetrain-lubricating oil to the cylinder head inlet upon a subsequent engine start-up.

In accordance with another feature of the invention, the system and method advantageously allow for the use of a single finished cylinder pad assembly to be used in an engine equipped with either variable cam timing or conventional fixed cam timing. Thus, for an engine to be equipped with variable cam timing, the module also includes a first bore or cavity adapted to receive a spool valve that is operative to direct a second portion of the unrestricted oil flow into a selected one of a plurality of additional passages leading to a hydraulically-responsive cam phaser unit. While the invention contemplates use of any suitable configuration for the oil feeds to the cam phaser unit, by way of example only, in an exemplary system, the additional passages leading to the cam phaser unit are routed back through additional ports defined in the external surface of the cylinder head. In the exemplary system, the module further provides a high-precision mount for the phase angle sensor to be used with the variable cam timing system.

In accordance with another feature of the invention, the module preferably further includes a second bore or cavity adapted to receive a filter, with the first passage intersecting the second cavity such that at least a portion of the unrestricted oil flow passes through the filter before being diverted by the spool valve to the variable cam timing system.

In this manner, the invention advantageously provides certain necessary components of a variable cam timing system in a single package while further eliminating the extra machining operations on the cylinder head that are typical of prior art systems, e.g., to accommodate the spool valve, phase angle sensor and associated pressurized oil circuits. Indeed, it will be appreciated that a variable-cost savings is readily achieved under the invention because component assembly operations are minimized, and because machined surfaces that are typically in the cylinder head are instead obtained on the much smaller oil flow control module, with faster manufacturing cycle times.

Other objects, features and advantages of the present invention are readily apparent from the following detailed description when taken in connection with the accompanying drawings.

DETAILED DESCRIPTION OF THE PREFERRED EMBODIMENTS

Figure 1:
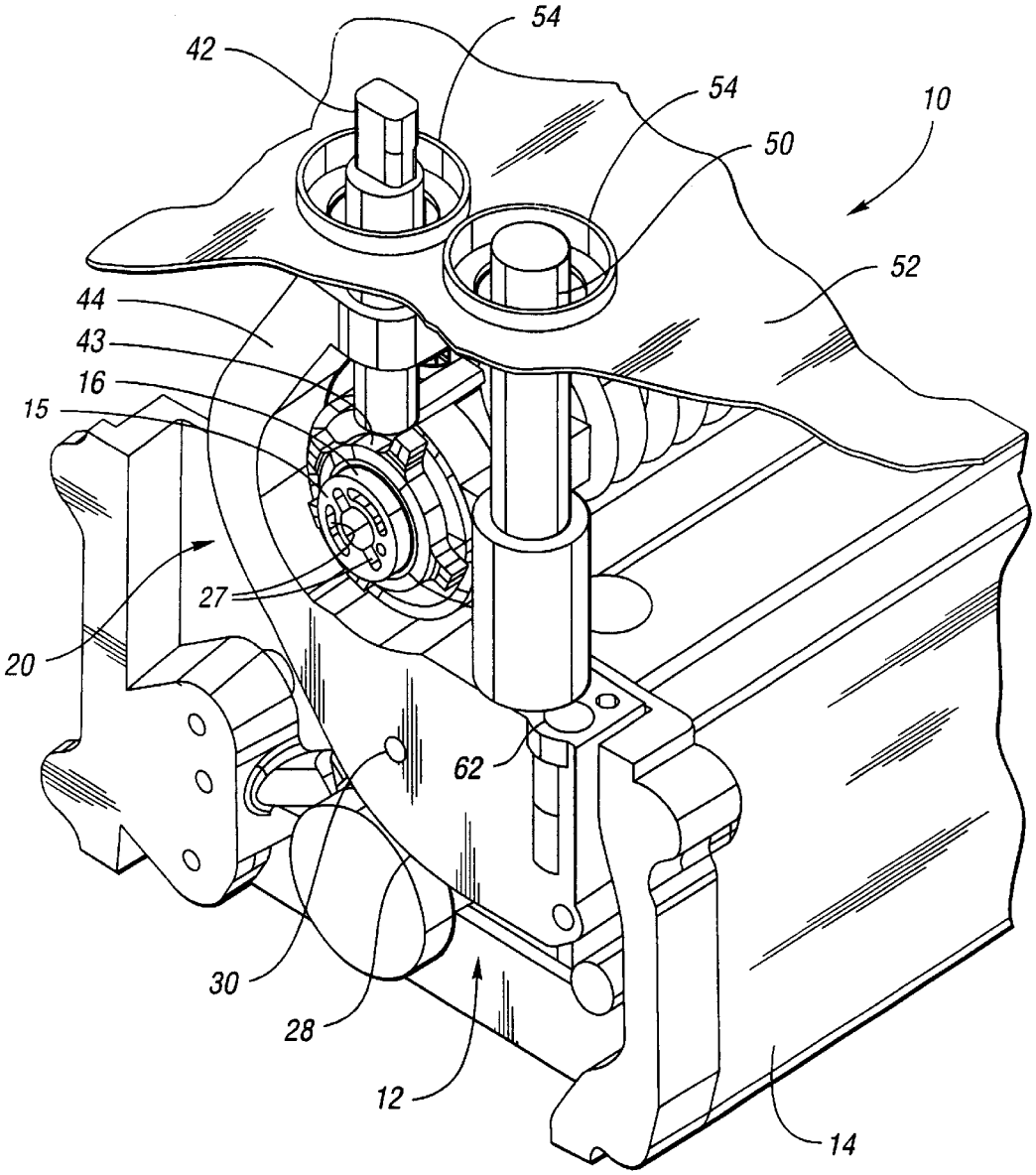
FIG. 1 is a partial view in perspective of a first cylinder head and cam cover of a "V"-configuration internal combustion engine featuring an exemplary system for controlling a flow of pressurized oil to both the cylinder head and a hydraulically-responsive cam phaser unit (the latter, normally received on the end of the illustrated cam shaft, being removed for clarity of illustration)
Figure 2:
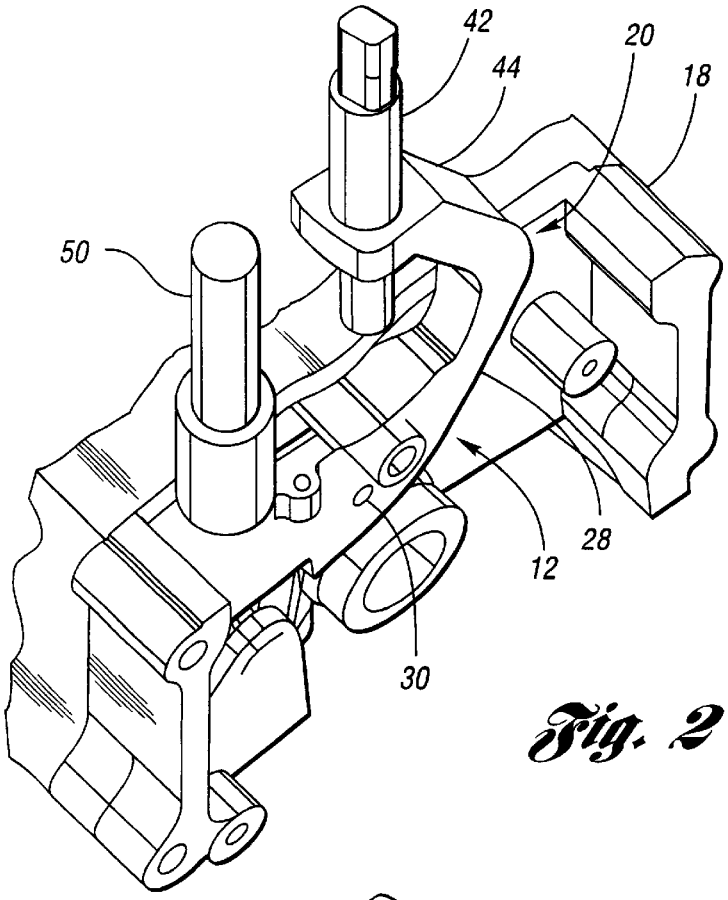
FIG. 2 is a partial view in perspective of a second cylinder head to which a second exemplary oil flow control module is attached, with the camshaft and cam phaser unit removed for clarity of illustration.

Referring to the Drawings, wherein like elements are designated using like reference numerals in each of the several views, FIG. 1 is a partial view in perspective of the right-hand cylinder head and cam cover assembly 10 of a "V"-configuration internal combustion engine featuring an exemplary system 12 for controlling a flow of pressurized oil to the cylinder head 14 and a hydraulically-responsive cam phaser unit (not shown) supported in any suitable manner on the end 15 of the camshaft 16. FIG. 2 similarly provides a partial view in perspective of the engine's left-hand cylinder head 18, with the cam cover, camshaft, and cam phaser unit removed for clarity of illustration.

Figure 3:
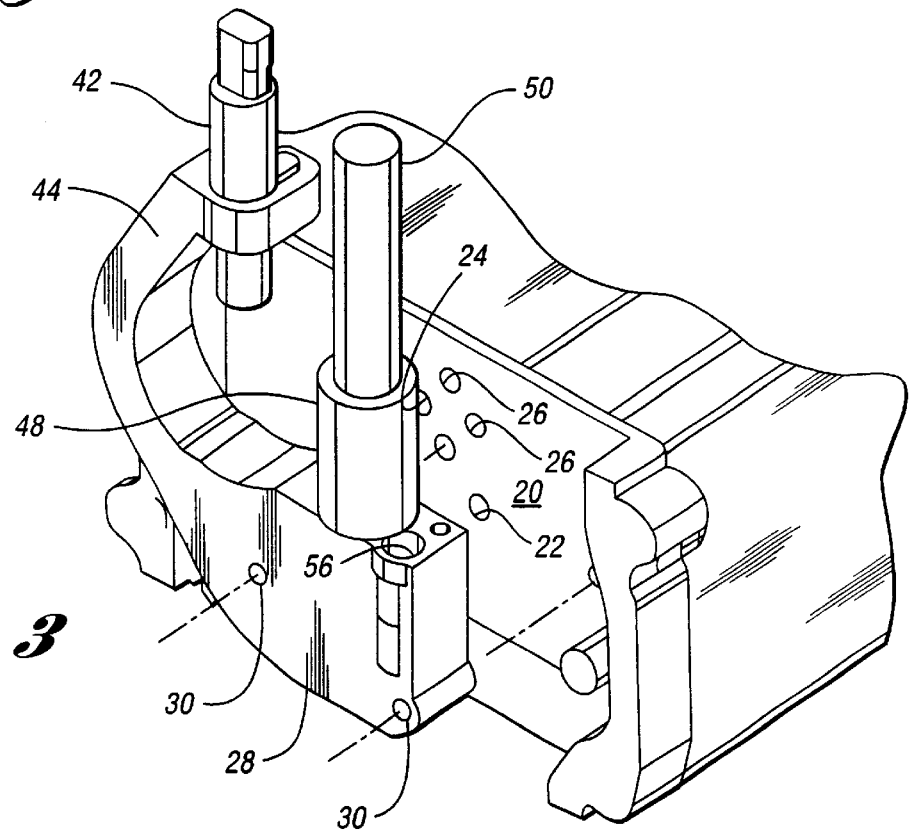
FIG. 3 is an exploded a few in perspective of a first exemplary oil flow control module, similar to that illustrated in FIG. 1, prior to attachment of the first module to a generally-flat face of the first cylinder head.

As best seen in the context of the right-hand cylinder head 14 as illustrated in FIG. 3, each cylinder head 14,18 includes a generally-flat external surface 20 having an outlet 22 through which a supply of oil, as pressurized by the engine's oil pump (not shown), is ported externally of the cylinder head 14,18. While the invention contemplates placement of the outlet 22 in the cylinder head 14,18 at any suitable location, in the exemplary system 10 illustrated in the FIGURES, the outlet 22 is preferably placed as close to the engine's oil pump as possible.

Each cylinder head's external surface 20 also includes an inlet 24 which receives at least a portion of the oil flow out of the outlet 22, as routed by the subject oil flow control system 12, for valvetrain lubrication. In the exemplary system 12, each cylinder head's external surface 20 further includes a pair of oil-receiving ports 26 which are in fluid communication with the cam phaser unit 16, for example, by way of oil passages respectively formed in the camshaft bearings (not shown) and in the camshaft 16 (as illustrated in FIG. 1 by advance and return passages 27).

Returning to FIGS. 1 and 2, the exemplary system 12 includes an oil flow control module 28 attached to the external surface 20 of each cylinder head 14,18. While the invention contemplates any suitable manner of attaching or securing each module 28 to the external surface 20 of its respective cylinder head 14,18, as seen in FIG. 3, in the exemplary system 12, each module 28 is attached to its respective cylinder head 14,18 by a plurality of threaded fasteners (not shown). Preferably, each fastener passes through a hollow or tubular locating pin 30 such that the mating surface 32 of each module 28 is precisely aligned with its respective cylinder head 14,18.

Figure 4:
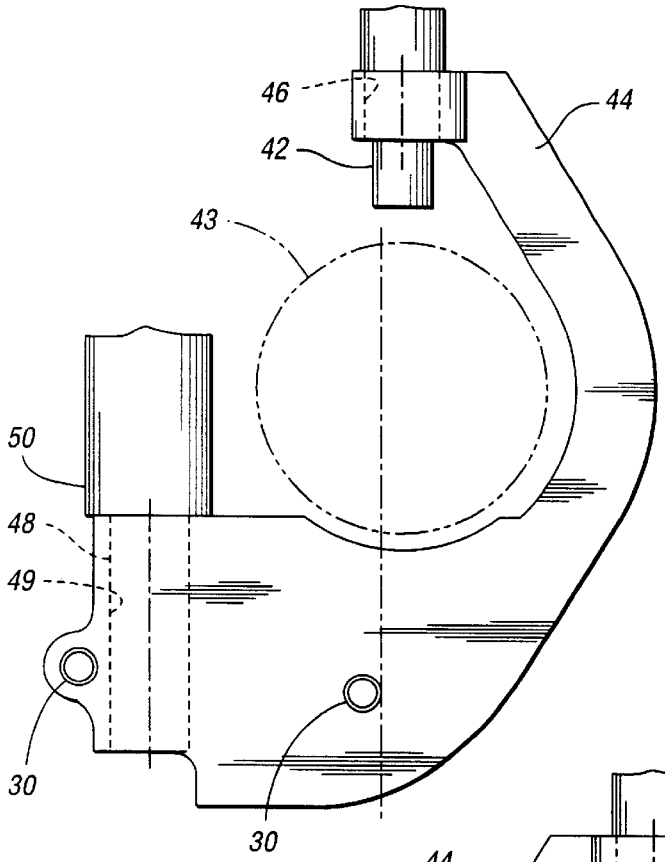
FIG. 4 is a front elevational view of the second module.
Figure 5:
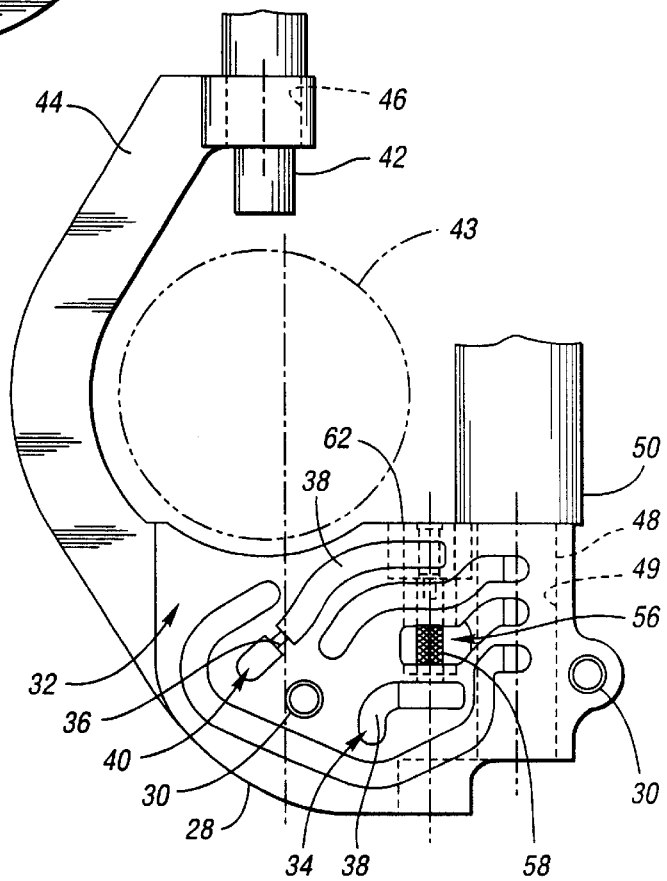
FIG. 5 is a rear elevational view of the second module further illustrating a plurality of worm grooves formed in the rear, generally-flat mating surface of the module.

As illustrated in FIGS. 4 and 5 in the context of the left-hand cylinder head assembly 10, each module 28 further includes a first passage 34 that places the cylinder head's outlet 22 in fluid communication with its inlet 24. Significantly, a downstream, relatively-reduced-hydraulic-diameter section of the first passage 34 defines a restrictor 36 within the module 36. The placement of the restrictor 36 in the module 28 advantageously obviates the need to otherwise provide such a restrictor within the cylinder head 14,18 or, as is often the case in the prior art, in the cylinder head gasket (not shown).

In accordance with a feature of the invention, at least a portion 38 of the module's first passage 34 (and, as described more fully below, other passages in the module 28) is defined by a worm groove formed in the generally-flat mating surface 32 of the module 28. And, while the invention contemplates defining the module's worm grooves using any suitable manufacturing method, in the exemplary system 12, the module 28 is die cast to thereby provide better detail and surface finish and, hence, reducing the need for additional machining. The invention further contemplates use of any suitable seal by which to substantially fluidly isolate adjacent worm grooves. In the exemplary system, a "cast-in-place" polymeric gasket (not shown) is preferably provided on the mating surface 32 of the module 28 to obtain the required seal between the cylinder head's external surface 20 and the module's mating surface 32.

In accordance with another feature of the invention, another section of the first passage 34 downstream of the restrictor 36 defines an oil reservoir 40 of predetermined capacity. Preferably, the oil reservoir 40 is positioned at a relative height on the engine below the inlet 24 of the cylinder head 14,18, whereby oil is contained in the reservoir 40 during engine shut-off. In this manner, lubricating oil is advantageously provided to the engine's valvetrain, for example, the engine's intake lash adjusters, upon subsequent engine start-up.

Significantly, under the invention, each module 28 may additionally provide several necessary components of a variable cam timing system, as illustrated in the Drawings. In this manner, the invention advantageously provides for the assembly, on a single assembly line using shared parts, of both variable-cam-timing-equipped engines (using the illustrated modules 28) and fixed-cam-timing-equipped engines (using modules which minimally include the first passage with the restrictor).

Thus, as seen in FIGS. 1 and 2, for engines to be equipped with variable cam timing, each module 28 also includes a phase angle sensor 42 for use with a pulse wheel 43 mounted on the camshaft 16. While the module 28 supports the phase angle sensor 42 in any suitable manner, in the exemplary system 12, a cantilevered portion 44 of the module 28 extends outwardly and upwardly from the external surface 20 of the cylinder head 14,18 to thereby define a mounting aperture 46 within which to conveniently receive the phase angle sensor 42, either before or after the module 28 is secured to the cylinder head 14.

Each exemplary module 28 also includes a control valve, such as a solenoid-operated spool value 48, received in a first cavity 49 defined in the module 28. The spool valve 48 is operative to direct a second portion of the externally-ported oil flow from the cylinder head 14,18 into either of the oil-receiving passages 26 in the cylinder head leading to the cam phaser unit. Conveniently, in the exemplary system 12, the spool valve actuator 50 and the phase angle sensor 42 each extend upwardly away from the cylinder head 14,18 in substantially parallel-spaced relation, such that each projects through the cam cover 52 to facilitate electrical interconnection with a vehicle wiring harness (not shown). Most preferably, each module 28 includes a combined electrical connector (not shown) by which both the spool valve actuator 50 and the phase angle sensor 42 are electrically interconnected with the wiring harness. A pair of rubber grommets 54 provide resilient seals around the spool valve actuator 50 and the phase angle sensor 42 as they pass through the cam cover 52.

In accordance with another feature of the invention, each module 28 further includes a second cavity 56 which intersects the first passage 34. The module's second cavity 56 is adapted to receive a suitable filter element, such as a screen filter 58 as seen in FIG. 3. The screen filter 58, which is of a "flow-through" design, operates to remove contaminants from oil diverted to the spool valve 48, with the screened contaminants otherwise returning to the cylinder head inlet 24 to thereby beneficially render the screen filter 58 "self-cleaning." A removable plug 62 conveniently seals the upper end of the second cavity 56, as seen in FIGS. 1 and 2, further facilitating assembly of the module 28.

As noted above, in accordance with another feature of the invention, the spool valve 48 on each module 28 is operative to direct or divert a portion of the filtered but, preferably, unrestricted oil flow in the first passage 34 into one of the cylinder head passages 26 leading to the cam phaser unit. The diversion by the spool valve 48 of unrestricted oil flow advantageously provides a substantially continuous supply of oil to the cam phaser unit even at relatively-low engine rpm, for example, when idling with a hot engine (with relatively thin oil).

While an exemplary system and method have been illustrated and described, it should be appreciated that the invention is susceptible of modification without departing from the spirit of the invention or the scope of the subjoined claims.

What is claimed is:

1. A system for controlling a flow of pressurized oil in an internal combustion engine comprising:

a cylinder head including a generally-flat external surface, wherein a pressurized oil outlet and a pressurized oil inlet are defined in the external surface; and an oil flow control module including a generally-flat mating surface secured against the external surface of the cylinder head, wherein the module includes at least a first passage placing the outlet of the cylinder head in fluid communication with the inlet of the cylinder head, the first passage including an oil restrictor.

2. The system of claim 1, wherein the restrictor is defined by a first section of the first passage, the first section having a relatively-reduced hydraulic diameter.

3. The system of claim 1, wherein the module includes a plurality of additional passages, and wherein the system further includes a control valve operative to direct a first portion of the oil flow into a selected one of the additional passages.

4. The system of claim 3, wherein the module includes a first cavity intersecting the first passage, and wherein the control valve is a spool valve received in the first cavity.

5. The system of claim 1, wherein the module includes a second cavity adapted to receive a filter, and wherein the first passage intersects the second cavity such that at least the first portion of the oil flow passes through a filter received in the second cavity.

6. The system of claim 1, wherein at least a portion of the first passage is defined by opposing, complimentary surfaces defined in the external surface of the cylinder head and the mating surface of the module, respectively.

7. The system of claim 1, wherein the cylinder head and the module include a plurality of aligned, right-cylindrical bores defined in complimentary, adjacent portions of the first surface and the second surface, respectively; and further including locating pins disposed in the bores.

8. The system of claim 1, including a phase angle sensor supported by the module.

9. The system of claim 1, wherein the first passage further defines a reservoir disposed between the restrictor and the inlet of the cylinder head.

10. The system of claim 9, wherein the reservoir arranged to be positioned below the inlet of the cylinder head, whereby oil is contained in the reservoir during engine shut-off.

11. The system of claim 1, further including a gasket disposed between the first surface of the cylinder head and the second surface of the module.

12. The system of claim 11, wherein the gasket is integrated within the module.

13. An oil supply and control module for a cylinder head of an internal combustion engine, wherein the cylinder head includes a generally-flat external surface having an outlet for porting pressurized oil out of the engine and an inlet for receiving pressurized oil for lubricating a valvetrain component of the engine, the module comprising:

a generally-flat mating surface adapted to be secured against the external surface of the cylinder head; and at least a first passage in the module placing the outlet of the cylinder head in fluid communication with the inlet of the cylinder head, wherein the first passage includes an oil restrictor.

14. The module of claim 13, wherein the restrictor is defined by a reduced-hydraulic-diameter section of the first passage.

15. The module of claim 13, wherein the module includes a plurality of additional passages, and a control valve on the module operative to direct at least a first portion of the oil flow into a selected one of the additional passages.

16. The module of claim 15, including a first cavity intersecting the first passage, and wherein the control valve is a spool valve disposed in the first cavity.

17. The module of claim 13, wherein the module includes a second cavity adapted to receive a filter, and wherein the first passage intersects the second cavity such that at least the first portion of the oil flow passes through a filter received in the second cavity.

18. The module of claim 13, wherein at least a portion of the first passage is defined by a worm groove in the second surface of the module.

19. The module of claim 13, including a phase angle sensor supported by the module.

20. The module of claim 13, wherein the first passage further defines a reservoir downstream of the restrictor.

21. A method of controlling a flow of pressurized oil to a valve train disposed within a cylinder head of an internal combustion engine, the method including:

porting unrestricted pressurized oil into a first passage external to the cylinder head;

restricting oil flow through the first passage; and directing the restricted flow back into the cylinder head.

22. The method of claim 21, including collecting a predetermined amount of restricted oil in a first section of the passage.

23. The method of claim 21, including selectively diverting a first portion of the unrestricted oil to a plurality of additional passages external to the cylinder head, whereby unrestricted oil is supplied to a cam phaser unit supported on the cylinder head.

24. The method of claim 23, including, before selectively diverting, filtering at least the first portion of the unrestricted oil.

* * * * *